US007708020B2

(12) United States Patent
Dittrich et al.

(10) Patent No.: US 7,708,020 B2
(45) Date of Patent: May 4, 2010

(54) SMOKING ARTICLES AND SMOKABLE FILLER MATERIALS THEREFOR

(75) Inventors: David John Dittrich, Hants (GB); Joseph Peter Sutton, Southampton (GB); Steven Coburn, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 719 days.

(21) Appl. No.: 10/488,126

(22) PCT Filed: Aug. 21, 2002

(86) PCT No.: PCT/GB02/03848

§ 371 (c)(1),
(2), (4) Date: Feb. 27, 2004

(87) PCT Pub. No.: WO03/020056

PCT Pub. Date: Mar. 13, 2003

(65) Prior Publication Data

US 2005/0034739 A1 Feb. 17, 2005

(30) Foreign Application Priority Data

Sep. 1, 2001 (GB) ..... 0121240.6
Sep. 7, 2001 (GB) ..... 0121620.9

(51) Int. Cl.
*A24B 15/00* (2006.01)
*A24B 1/00* (2006.01)

(52) U.S. Cl. ..... 131/352; 131/359; 131/364

(58) Field of Classification Search ..... None
See application file for complete search history.

(56) References Cited

U.S. PATENT DOCUMENTS

| | | | | |
|---|---|---|---|---|
| 2,172,357 | A * | 9/1939 | Brown | 252/194 |
| 3,145,717 | A | 8/1964 | Osborne et al. | |
| 3,297,039 | A | 1/1967 | Osborne et al. | |
| 3,987,801 | A | 10/1976 | Artho et al. | |
| 4,164,948 | A | 8/1979 | Beringer et al. | |
| 4,453,553 | A * | 6/1984 | Cohn | 131/365 |
| 4,506,684 | A | 3/1985 | Keritsis | |
| 4,625,737 | A | 12/1986 | Keritsis et al. | |
| 5,060,675 | A | 10/1991 | Milford et al. | |
| 5,101,839 | A * | 4/1992 | Jakob et al. | 131/352 |
| 5,129,408 | A * | 7/1992 | Jakob et al. | 131/352 |

FOREIGN PATENT DOCUMENTS

| | | |
|---|---|---|
| JP | 2000506015 | 9/1997 |
| JP | 2001501452 | 2/2001 |
| WO | 9732492 | 3/1997 |
| WO | 9732490 | 9/1997 |
| WO | 9732491 | 9/1997 |

* cited by examiner

*Primary Examiner*—Philip C Tucker
*Assistant Examiner*—Michael J Felton
(74) *Attorney, Agent, or Firm*—Charles I. Sherman; Middleton Reutlinger

(57) ABSTRACT

This invention relates to a smoking article having a controllable static burn rate by virtue of the particle size of a component of the smoking material thereof. The smoking material comprises a non-combustible inorganic filler, a binder, aerosol generating means, the non-combustible filler comprising a proportion of material having a mean particle size in the range of 500 μm to 20 μm.

60 Claims, No Drawings

SMOKING ARTICLES AND SMOKABLE FILLER MATERIALS THEREFOR

CROSS REFERENCE TO PRIOR APPLICATION

This application is a national stage filing (35 U.S.C. 371) of PCT/GB02103848, which claims priority to and benefit of Great Britain Patent Application No. 0121620.9, filed on Sep. 7, 2001, currently pending; and claims priority to and benefit of Great Britain Patent Application No. 0121240.6, filed Sep. 1, 2001, currently pending.

This invention relates to smokable filler materials, which may be tobacco substitute materials, and smoking articles incorporating such materials.

It has been an object over many years to provide a smokable filler material that has a reduced amount of biological material therein, in order to reduce the potential health problems that appear to be related to the burning of such biological material, i.e. tobacco. To this end there is a large body of prior art relating to tobacco substitute materials or alternative smoking material. A problem with such alternative materials is that, with decreased amounts of combustible material in the smoking material, the combustion characteristics of the alternative materials can be difficult to control. Certain well-known combustion modifiers, e.g. burn additives, such as alkali metal salt of organic acids, sodium or potassium acetate, for example, or burn retardants, e.g. calcium or magnesium chloride, are then required in order to control the burn rate.

U.S. Pat. No. 4,109,664 describes the use of a cellulosic binder, at least a proportion thereof being a thermo-gelling substituted cellulose, in addition to the generation of air bubbles in the slurry using a high shear mixer. International Patent Application, Publication No. WO 96/07336 and European Patent, Publication No. 0 419 975 describe smoking materials using inorganic filler materials (sometimes agglomerated, as in EP 0 419 975), binder and aerosol generating means. In none of these documents is any mention made of the particle size of the inorganic filler material, nor of their effect on the static burn rate of a smoking article comprising these smoking materials.

This invention is predicated on the finding that a novel smoking material has been produced which incorporates non-combustible inorganic filler material, the mean particle size of which material has an advantageous effect on the burning characteristics of the smoking material.

It is also an object of the invention to provide a smoking material that has positive effects on one or more of the taste, smoke flavour or ash characteristics of a smoking article incorporating that material.

It is a further object to provide a method of controlling the delivery on a per puff basis of a smoking article incorporating the novel smoking material.

It is a yet further object to provide a method of controlling the static burn rate of a smoking material having a predetermined formulation.

The present invention provides a smoking material comprising a non-combustible inorganic filler, a binder, aerosol generating means, the non-combustible filler comprising a proportion of material having a mean particle size in the range of 500 μm to 20 μm.

The present invention further provides a method of controlling the static burn rate of a smoking article, wherein the smoking article comprises a rod of smokable filler material enwrapped in a wrapper, said smokable filler material incorporating a proportion of a smoking material comprising a non-combustible inorganic filler material, a binder and aerosol generating means, said inorganic filler material comprising a proportion of material having a mean particle size in the range of 500 μm-20 μm, the particle size of the inorganic filler material being selected to provide the desired static burn rate, and/or an amount of smoking material being selected in conjunction with an amount of tobacco material in a blend of smokable filler material to provide the desired static burn rate.

The present invention also provides a smoking article comprising a rod of smokable filler material enwrapped in a wrapper, said smokable filler material incorporating a proportion of the smoking material according to the invention.

Preferably the inorganic filler material is present in the range of 60-90%, more preferably 65-85%, even more preferably greater than 65%, and even more preferably >70%, by weight of the final sheet material. Advantageously the inorganic filler material is present at about 75% by weight of the final sheet material.

Preferably the mean particle size of the inorganic filler is in the range of 500 μm-30 μm, more preferably 400 μm-50 μm, even more preferably in the range of 200-150 μm and is most preferably at or about 170 μm. This particle size is in contrast to that conventionally used for inorganic filler materials in alternative tobacco products, namely a particle size of about 2-3 μm. The range of particle size seen for each inorganic filler individually may be from 1 μm-1 mm (1000 μm). The inorganic filler material may be ground, milled or precipitated to the desired particle size.

Advantageously the inorganic filler material is one or more of perlite, alumina, diatomaceous earth, chalk, vermiculite, magnesium oxide, magnesium sulphate or other inorganic filler materials. The density range of the materials is suitably in the range of 0.1-3.97 g/cm$^3$.

If a combination of inorganic filler materials are used, one or more of the fillers may suitably be of a small particle size and another may be of a larger particle size, the proportions of each filler being suitable to achieve the desired mean particle size. The static burn rate required in the finished smoking article may be achieved using an appropriate blend of tobacco and smoking material in the smokable filler material.

Preferably the inorganic filler material is not in agglomerated form. The inorganic filler material should require little pre-treatment, other than perhaps size gradation, before use.

Preferably the binder is present in the range of about 5-13%, more preferably more than 6% and even more preferably more than 7%, by weight of the final sheet material. Advantageously the binder is about 7.5% by weight of the final sheet material.

Advantageously the binder is an organic binder and is most advantageously an alginic binder. If the binder is a mixture of alginate and non-alginate binders, then preferably the binder is comprised of at least 50% alginate, preferably at least 60% alginate and even more preferably at least 70% alginate. The amount of combined binder required may suitably decrease when a non-alginate binder is utilised. The amount of alginate in a binder combination advantageously increases as the amount of combined binder decreases. Suitable binders include soluble alginates, such as ammonium alginate, sodium alginate, sodium calcium alginate, calcium ammonium alginate, potassium alginate, magnesium alginate, triethanolamine alginate and propylene glycol alginate. Other organic binders such as cellulosic binders, gums or gels can also be used. Suitable cellulosic binders include cellulose and cellulose derivatives, such as sodium carboxymethylcellulose, methyl cellulose, hydroxypropyl cellulose, hydroxyethyl cellulose or cellulose ethers. Suitable gums include gum arabic, gum ghatti, gum tragacanth, Karaya, locust bean, acacia, guar, quince seed or xanthan gums. Suitable gels include agar, agarose, carrageenans, furoidan and furcellaran. Starches can also be used as organic binders. Other suitable gums can be selected by reference to handbooks, such as Industrial Gums, E. Whistler (Academic Press).

Much preferred as the binder are alginic binders. Alginates are preferred in the invention for their burning properties.

Preferably the aerosol generating means is present in the range of 5-15%, more preferably 7-13% and even more preferably 10-13%. Most preferably the aerosol generating means is between 11 and 13%, and may advantageously be 11.25% or 12.5%, by weight of the final sheet material. Suitably the amount of aerosol generating means is selected in combination with the amount of tobacco material to be present in the blend comprising the smokable filler material of a smoking article. For example, in a blend comprising a high proportion of sheet material with a low proportion of tobacco material, the sheet material may require a lower loading level of aerosol generating means therein.

Advantageously the or a proportion of the aerosol generating means may be encapsulated, preferably micro-encapsulated, or stabilised in some other way. In such cases the amount of aerosol generating means may be higher than the range given.

Preferably a smoking article according to the invention comprises tobacco material being treated with aerosol generating means. Preferably the amount of aerosol generating means added to the tobacco is in the range of 2-6% by weight of the tobacco, but may suitably be up to 12%.

Suitable aerosol generating means include aerosol forming means selected from polyhydric alcohols, such as glycerol, propylene glycol and triethylene glycol; esters, such as triethyl citrate or triacetin, high boiling point hydrocarbons, or non-polyols, such as glycols, sorbitol or lactic acid, for example. A combination of aerosol generating means may be used. An additional function of the aerosol generating means is the plasticising of the sheet material. Suitable additional plasticisers include water.

Advantageously the smoking material comprises a colourant to darken the material and/or a flavourant to impart a particular flavour. Suitable flavouring or colourant materials include cocoa, liquorice, caramel, chocolate or toffee, for example. Finely ground, granulated or homogenised tobacco may also be used. Industry approved food colourants may also be used, such as E150a (caramel), E151 (brilliant black BN, E153 vegetable carbon or E155 (brown HT). Suitable flavourants include menthol and vanillin, for example. Other casing materials may also be suitable. In the alternative, the presence of vermiculite or other inorganic filler materials may give a darker colour to the smoking material. It has been found that if the whiteness of the inorganic filler material is less than 95Y, such as for V100 chalk, no colourant is necessarily required.

Preferably the colourant or flavourant is present from 0-10% and more preferably is 5-7% by weight of the final smoking material. Advantageously the colourant or flavourant is 5%, 6% or 7% of the final smoking material. When the colourant or flavourant is cocoa or liquorice, for example, the minimum amount thereof is 2-3%. Cocoa may suitably be present in a range of 0-5%, preferably about 4% and liquorice may be present in a range of 0-4%, preferably about 2%, by weight of the final smoking material.

Advantageously, if a food dye is utilised in the alternative it is present at at least 0.5% by weight of the final smoking material. The colourant may alternatively be dusted into the sheet after sheet manufacture.

Fibres, such as wood pulp or cellulose fibres, could be added to provide the sheet material with one or more of a higher strength, lower density or higher fill value. Fibres may be present in the range of 1-10%, preferably 2-5% and even more preferably about 3% by weight of the final sheet material.

Surprisingly, sheet material according to the invention has sufficient strength and is of an acceptable density without the need for high shear mixing to generate aeration or the addition of thermo-gelling binders. Preferably the tensile strength of the smoking material sheet is in the range of 1-2 N/mm. Although lower than a conventional reconstituted tobacco sheet (because of the absence of fibre found in such reconstituted sheets), the material is still strong enough to undergo the rigours of normal sheet processing. It is believed that this is possibly because of a minor amount of cross-linking that occurs between the calcium ions in the chalk and the sodium ions in the sheet during the drying process. It has been found that an improvement in strength can be obtained if additional amounts of cross-liking calcium salts are added to the sheet slurry.

Preferably the density of the sheet, as measured using the mercury porosity method, is in the range of 0.7-1.5 g/cc, preferably 0.9-1.2 g/cc. The mercury porosity method gives an apparent or skeletal density measurement.

The filling value of the sheet is in the range of 1.2-1.8 cc/g, and is suitably about 1.5 cc/g. Reconstituted tobacco sheet has a filling value in the range of 3-6 cc/g.

Preferably the smoking material is blended with tobacco material to provide smokable filler material. Advantageously the majority of the tobacco material is cut tobacco. The inclusion levels of smoking material according to the invention and tobacco material are advantageously in the range of 25:75 (smoking material:tobacco)-75:25, and is preferably in the range of 60:40 for a full flavour product delivering about 12 mg nicotine free dry particulate matter (NFDPM).

Ventilation may advantageously be used in the smoking article according to the invention in order to reduce delivery to <9 mg NFDPM. The delivery may be in the range of 2-6 mg NFDPM. Alternatively, or in addition thereto, the blend of the smokable filler may be altered to increase the amount of smoking material according to the invention, in order to reduce the smoke component delivery.

Applicant has found that with careful selection of the particle size of the inorganic filler material, for a given formulation the static burn rate of the smoking material of the present invention can be altered without the need to alter the formulation. This represents a significant new tool to the product developer and cigarette designer. In addition, the smoke taste and flavour characteristics and the physical characteristics of a smoking article incorporating the smoking material according to the invention are largely controlled by the particle size selection of the inorganic filler.

Preferably the static burn rate of a smoking article comprising sheet material according to the invention is within the range of 3 mm/min to 8 mm/min. More preferably the static burn rate is in the range of 4-7.5 mm/min. Most preferably the static burn rate is in the range of 4-6 mm/min.

Advantageously the smoking material is a non-tobacco containing sheet.

The following Examples illustrate the invention.

EXAMPLE 1

Smoking materials according to the invention were made by weighing up a 3 kg dry formulation consisting of 74% chalk (inorganic filler material), 12% glycerol (aerosol generating means), 8% sodium alginate (binder), 4% cocoa and 2% liquorice (colourants/flavourants). 8 liters of water was gradually added to a dry mixture of chalk, glycerol, cocoa and liquorice. The alginate is added to the mixture with the water. The mixture was mixed using a SILVERSON mixer until the slurry reached an appropriate consistency (150,000 cps). The slurry was then cast using a heated drum caster to produce a wet sheet of 1 mm thickness. The material was shredded at 31 cpi using a shredder, blended with cut tobacco and made into cigarettes. Cigarettes of 84 mm length comprising a 27 mm filter were wrapped with a paper of 50 CU. Table 1 details the composition and physical characteristics of the chalk used. A control cigarette comprising a blend of 100% tobacco was used, being an all lamina mix consisting of flue-cured, Burley and Oriental grades, 40% of the total blend being DIET expanded tobacco. Each set of test cigarettes comprised a blend of 40% tobacco and 60% smoking material sheet according to the invention. The cigarettes were smoked under ISO standard machine smoking conditions according to which a 3 5 $cm^3$ puff of two seconds duration is taken every minute.

TABLE 1

| | S479 | S480 | S481 | S482 | S483 | S484 |
|---|---|---|---|---|---|---|
| Chalk | 100% V100 | 100% V100 | 100% V60 | 50% pptd 50% V100 | 100% pptd | — |
| Mean Particle Size | 250μ | 250μ | 100-80μ | — | 2μ | — |
| Tobacco | — | — | — | — | | 100% |
| Puff Number | 7.4 | 7.1 | 7.3 | 5.2 | 5.1 | 5.0 |
| Static Burn Rate (mm/min) | 4.72 | 5.09 | 5.19 | 6.95 | 7.07 | 6.53 |

It can be seen from Table 1 that as particle size decreases, the static burn rate of the smoking article increases. Optimising the particle size and the mixtures of different particle sizes will provide a significant new tool for the cigarette designer.

EXAMPLE 2

A further sheet material was made up by drum casting the formulation consisting of 75.25% chalk, 11.25% glycerol, 7.5% binder, 4% cocoa and 2% liquorice. The mean particle size of the chalk was about 170 μm. This sheet material exhibited acceptable smoulder characteristics and physical characteristics, such as ashing.

EXAMPLE 3

Three sets of cigarettes were produced to the same dimensions as in Example 1. One set comprised 100% tobacco (as per the tobacco of Example 1), the second set comprised sheet material utilising 100% V100 chalk and the third set comprised sheet material utilising 100% precipitated chalk. The formulation of the sheet material was the same as Example 2. The burning measurements given in Table 2 were obtained under ISO standard smoking conditions.

TABLE 2

| | | S295 (100% tobacco | S384 (100% V100 chalk) | S382 (100% precipitated chalk) |
|---|---|---|---|---|
| Heat of combustion in the blend (Keal/cig) | | 1.8 (7.54 kJ) | 1.7 (7.12 kJ) | 1.5 (6.28 kJ) |
| Peripheral combustion | Smouldering between puffs | 767.8 | 762.0 | 765.6 |
| | Puffing | 866.9 | 820.8 | 883.3 |
| Inner pyrolysis | Smouldering between puffs | 731.2 | 690.4 | 653.4 |
| | Puffing | 754.6 | 709.5 | 731.0 |

From Table 2 it is clear that, surprisingly, smoking articles according to the invention, despite having a smokable filler material comprising 60% sheet material according to the invention, maintain the same or similar combustion mechanisms as cigarettes comprising 100% tobacco.

We claim:

1. A smoking material comprising a non-combustible, non-agglomerated inorganic filler, a binder and 5-13%, by weight of the smoking material, of an aerosol generating material, the non-combustible, non-agglomerated filler having a mean particle size in the range of 500 μm to 20 μm, the non-combustible, non-agglomerated inorganic filler being present in the range of 75-90% by weight of the smoking material, and the binder comprising an alginic binder present in the amount of at least 50% of the total amount of binder.

2. A smoking material comprising a non-combustible, non-agglomerated inorganic filler, a binder and 5-13%, by weight of the smoking material, of an aerosol generating material, the non-combustible, non-agglomerated filler having a mean particle size in the range of 500 μm to 20 μm, the non-combustible, non-agglomerated inorganic filler being present in the range of 75-90% by weight of the smoking material, and the binder comprising a soluble alginic binder, and the smoking material having no additional added fibres present therein.

3. A smoking material according to claim 1, wherein the inorganic filler material is present in the range of 75-85% by weight of the smoking material.

4. A smoking material according to claim 1, wherein the inorganic filler material is present at 75% by weight of the smoking material.

5. A smoking material according to claim 1, wherein the mean particle size of the inorganic filler is in the range of 500 μm-30 μm.

6. A smoking material according to claim 5, wherein the mean particle size of the inorganic filler is in the range of 400 μm-50 μm.

7. A smoking material according to claim 6, wherein the mean particle size of the inorganic filler is in the range of 200 μm-150 μm.

8. A smoking material according to claim 7, wherein the mean particle size of the inorganic filler is at or about 170 μm.

9. A smoking material according to claim 1, wherein the inorganic filler material is one or more of perlite, alumina, diatomaceous earth, chalk, vermiculite, magnesium oxide, magnesium sulphate or other inorganic filler materials.

10. A smoking material according to claim 1, wherein the density range of the inorganic filler material is in the range of 0.1-3.97 g/cm$^3$.

11. A smoking material according to claim 1, wherein the binder is present in the range of about 5-13% by weight of the smoking material.

12. A smoking material according to claim 11, wherein the binder is present at more than 6% by weight of the smoking material.

13. A smoking material according to claim 12, wherein the binder is present at more than 7% by weight of the smoking material.

14. A smoking material according to claim 13, wherein the binder is present at or about 7.5% by weight of the smoking material.

15. A smoking material according to claim 1, wherein the binder is selected from the group consisting of ammonium alginate, sodium alginate, sodium calcium alginate, calcium ammonium alginate, potassium alginate, magnesium alginate, triethanol-amine alginate, propylene glycol alginate or combinations thereof.

16. A smoking material according to claim 1, wherein the aerosol generating material is present in the range of 7-13% by weight of the smoking material.

17. A smoking material according to claim 16, wherein the aerosol generating material is present in the range of 10-13% by weight of the smoking material.

18. A smoking material according to claim 1, wherein the aerosol generating material is selected from the group consisting of a polyhydric alcohol, an ester, a high boiling point hydrocarbon, a non-polyol or combinations thereof.

19. A smoking material according to claim 1, wherein fibres are present in the range of 1-10% by weight of the smoking material.

20. A smoking material according to claim 2, wherein the inorganic filler material is present in the range of 75-85% by weight of the smoking material.

21. A smoking material according to claim 2, wherein the inorganic filler material is present at 75% by weight of the smoking material.

22. A smoking material according to claim 2, wherein the mean particle size of the inorganic filler is in the range of 500 μm-30 μm.

23. A smoking material according to claim 22, wherein the mean particle size of the inorganic filler is in the range of 400 μm-50 μm.

24. A smoking material according to claim 23, wherein the mean particle size of the inorganic filler is in the range of 200-150 μm.

25. A smoking material according to claim 24, wherein the mean particle size of the inorganic filler is at or about 170 μm.

26. A smoking material according to claim 2, wherein the inorganic filler material is selected from the group consisting of perlite, alumina, diatomaceous earth, chalk, vermiculite, magnesium oxide, magnesium sulphate or combinations thereof.

27. A smoking material according to claim 2, wherein the density range of the inorganic filler material is in the range of 0.1-3.97 g/cm$^2$.

28. A smoking material according to claim 2, wherein the binder is a mixture of alginate and non-alginate binders, the binder being comprised of at least 50% alginate.

29. A smoking material according to claim 28, wherein the binder comprises at least 60% alginate.

30. A smoking material according to claim 2, wherein the binder is present in the range of about 5-13% by weight of the smoking material.

31. A smoking material according to claim 30, wherein the binder is present at more than 6% by weight of the smoking material.

32. A smoking material according to claim 31, wherein the binder is present at more than 7% by weight of the smoking material.

33. A smoking material according to claim 32, wherein the binder is present at or about 7.5% by weight of the smoking material.

34. A smoking material according to claim 2, wherein the binder is selected from the group consisting of ammonium alginate, sodium alginate, sodium calcium alginate, calcium ammonium alginate, potassium alginate, magnesium alginate, triethanol-amine alginate, propylene glycol alginate or combinations thereof.

35. A smoking material according to claim 2, wherein the aerosol generating material is present in the range of 7-13% by weight of the smoking material.

36. A smoking material according to claim 35, wherein the aerosol generating material is present in the range of 10-13% by weight of the smoking material.

37. A smoking material according to claim 2, wherein the aerosol generating material is selected from the group consisting of a polyhydric alcohol, an ester, a high boiling point hydrocarbon, a non-polyol or combinations thereof.

38. A smoking article comprising a rod of smokable filler material enwrapped in a wrapper, said smokable filler material incorporating a proportion of tobacco material, and a proportion of a smoking material comprising a non-combustible, non-agglomerated inorganic filler material present in an amount of 75-90% by weight of the smoking material, a binder comprising a soluble alginic binder present in the amount of at least 50% of the total amount of binder, and 5-13%, by weight of the smoking material, of an aerosol generating material, said inorganic filler material having a mean particle size in the range of 500 μm-20 μm.

39. A smoking article according to claim 38, wherein the mean particle size of the inorganic filler material is selected to provide a static burn rate of the smoking article in the range of 4-7.5 mm/mm.

40. A smoking article according to claim 39, wherein the mean particle size of the inorganic filler material is selected to provide a static burn rate of the smoking article in the range of 4-6 mm/mm.

41. A smoking article according to claim 38, wherein said tobacco material contains aerosol generating material, the amount of aerosol generating material in said tobacco material being in the range of 2-12% by weight of said tobacco material.

42. A smoking article according to claim 38, wherein the ratio of the inclusion level of smoking material to tobacco material is in the range of 25:75 to 75:25.

43. A smoking material comprising three main components being a non-combustible, non-agglomerated inorganic filler present at 75% by weight, a binder present at 7.5% by weight and aerosol generating material present in the range of 11.25 to 12.5% by weight, the non-combustible, non-agglomerated filler having a mean particle size in the range of 500 μm to 20 μm, and said three main components together being in the range of 93.75-95% by weight of the smoking material.

44. A smoking material comprising a non-combustible, non-agglomerated inorganic filler, a binder and aerosol generating material, the non-combustible, non-agglomerated filler having a mean particle size in the range of 500 μm to 20 μm, the non-combustible, non-agglomerated inorganic filler being chalk present in the range of 74-90%, the aerosol generating material being glycerol in the range of 11.25-13% and the binder being sodium alginate in the range of 7.5-13%, all by weight of the smoking material.

45. A smoking article comprising a rod of smokable filler material enwrapped in a wrapper, said smokable filler material incorporating a proportion of tobacco material, and a proportion of a smoking material comprising a non-combustible, non-agglomerated inorganic filler, a binder and 5-13%, by weight of the smoking material, of an aerosol generating material, the non-combustible, non-agglomerated filler having a mean particle size in the range of 500 μm to 20 μm, the non-combustible, non-agglomerated inorganic filler being present in the range of 75-90% by weight of the smoking material, the binder comprising a soluble alginic binder, and the smoking material having no additional added fibres present therein; the inorganic filler material being of a particle size which provides a static burn rate for the smoking article within the range of 3 mm/mm to 8 mm/mm.

46. A smoking article according to claim 45, wherein said static burn rate for the smoking article is in the range of 4-7.5 mm/mm.

47. A smoking article according to claim 46, wherein said static burn rate for the smoking article is in the range of 4-6 mm/mm.

48. A smoking article according to claim 45, wherein said tobacco material contains aerosol generating material, the amount of aerosol generating material in said tobacco material being in the range of 2-12% by weight of said tobacco material.

49. A smoking article according to claim 45, wherein the ratio of the inclusion level of smoking material to tobacco material is in the range of 25:75 to 75:25.

50. A smoking article comprising a rod of smokable filler material enwrapped in a wrapper, said smokable filler material incorporating a proportion of tobacco material, and a proportion of a smoking material comprising three main components being a non-combustible, non-agglomerated inorganic filler present at 75% by weight, a binder present at 7.5% by weight and aerosol generating material present in the range of 11.25 to 12.5% by weight, the non-combustible, non-agglomerated filler having a mean particle size in the range of 500 μm to 20 μm, and said three main components together being in the range of 93.75-95% by weight of the smoking material.

51. A smoking article according to claim 50, wherein the particle size of the non-agglomerated filler is selected to provide a static burn rate of the smoking article is in the range of 4-7.5 mm/mm.

52. A smoking article according to claim 51, wherein said static burn rate of the smoking article is in the range of 4-6 mm/mm.

53. A smoking article according to claim 50, wherein, the amount of said aerosol generating material in said tobacco material being in the range of 2-12% by weight of said tobacco material.

54. A smoking article according to claim 50, wherein the ratio of the inclusion level of smoking material to tobacco material is in the range of 25:75 to 75:25.

55. A smoking article comprising a rod of smokable filler material enwrapped in a wrapper, said smokable filler material incorporating a proportion of tobacco material, and a proportion of a smoking material comprising a non-combustible, non-agglomerated inorganic filler material present in an amount of 75-90% by weight of the smoking material, a binder comprising a soluble alginic binder present in the amount of at least 50% of the total amount of binder, and 5-13%, by weight of the smoking material, of an aerosol generating material, said inorganic filler material having a mean particle size in the range of 500 μm-20 μm, and said smoking article having a static burn rate within the range of 3 mm/mm to 8 mm/mm.

56. A smoking article comprising a rod of smokable filler material enwrapped in a wrapper, said smokable filler material incorporating a proportion of tobacco material, and a proportion of a smoking material comprising a non-combustible, non-agglomerated inorganic filler, a binder and 5-13%, by weight of the smoking material, of an aerosol generating material, the non-combustible, non-agglomerated filler having a mean particle size in the range of 500 μm to 20 μm, the non-combustible, non-agglomerated inorganic filler being present in the range of 75-90% by weight of the smoking material, the binder comprising a soluble alginic binder, and the smoking material having no additional added fibres present therein; said smoking article having a static burn rate within the range of 3 mm/mm to 8 mm/mm.

57. A smoking article comprising a rod of smokable filler material enwrapped in a wrapper, said smokable filler material incorporating a proportion of tobacco material, and a proportion of a smoking material comprising three main components being a non-combustible, non-agglomerated inorganic filler present at 75% by weight, a binder present at 7.5% by weight and aerosol generating material present in the range of 11.25 to 12.5% by weight, the non-combustible, non-agglomerated filler having a mean particle size in the range of 500 μm to 20 μm, and said three main components being in the range of 93.75-95% by weight of the smoking material; said smoking article having a static burn rate within the range of 3 mm/mm to 8 mm/mm.

58. A smoking article according to claim 55, wherein the amount of said aerosol generating material in said tobacco material is in the range of 2-12% by weight of said tobacco material.

59. A smoking article according to claim 56, wherein the amount of said aerosol generating material in said tobacco material is in the range of 2-12% by weight of said tobacco material.

60. A smoking article according to claim 57, wherein the amount of said aerosol generating material in said tobacco material is in the range of 2-12% by weight of said tobacco material.

* * * * *